US008883384B2

(12) United States Patent
Dinh et al.

(10) Patent No.: US 8,883,384 B2
(45) Date of Patent: Nov. 11, 2014

(54) BINDERLESS OVERCOAT LAYER

(75) Inventors: Kenny-tuan T. Dinh, Webster, NY (US); Edward C. Savage, Webster, NY (US); Marc J. LiVecchi, Rochester, NY (US); Robert W. Hedrick, Spencerport, NY (US); Linda L. Ferrarese, Rochester, NY (US); Sherri A. Toates, Webster, NY (US); Stacy J. Kowsz, Hebron, CT (US)

(73) Assignee: Xerox Corporation, Norwalk, CT (US)

( * ) Notice: Subject to any disclaimer, the term of this patent is extended or adjusted under 35 U.S.C. 154(b) by 885 days.

(21) Appl. No.: 12/567,640

(22) Filed: Sep. 25, 2009

(65) Prior Publication Data

US 2010/0015540 A1 Jan. 21, 2010

Related U.S. Application Data

(63) Continuation-in-part of application No. 11/275,134, filed on Dec. 13, 2005, now Pat. No. 7,759,032.

(51) Int. Cl.
*G03G 5/06* (2006.01)
*G03G 5/147* (2006.01)

(52) U.S. Cl.
CPC ..... *G03G 5/0614* (2013.01); *G03G 5/14786* (2013.01); *G03G 5/14791* (2013.01); *G03G 5/14747* (2013.01)
USPC ..... 430/58.8; 430/66

(58) Field of Classification Search
USPC ..... 430/58.8, 66
See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,281,054 | A | 7/1981 | Horgan et al. | |
| 4,297,425 | A | 10/1981 | Pai et al. | |
| 4,298,697 | A | 11/1981 | Baczec et al. | |
| 4,338,390 | A | 7/1982 | Lu | |
| 4,387,980 | A | 6/1983 | Ueno et al. | |
| 4,390,609 | A | 6/1983 | Wiedemann | |
| 4,457,994 | A | 7/1984 | Pai et al. | |
| 4,560,635 | A | 12/1985 | Hoffend et al. | |
| 4,599,286 | A | 7/1986 | Limburg et al. | |
| 4,871,634 | A | 10/1989 | Limburg et al. | |
| 5,215,839 | A | 6/1993 | Yu | |
| 5,368,967 | A | 11/1994 | Schank et al. | |
| 5,418,107 | A | 5/1995 | Nealey et al. | |
| 5,660,961 | A | 8/1997 | Yu | |
| 5,681,679 | A | 10/1997 | Schank et al. | |
| 5,702,854 | A | 12/1997 | Schank et al. | |
| 5,709,974 | A | 1/1998 | Yuh et al. | |
| 5,958,638 | A | 9/1999 | Katayama et al. | |
| 5,976,744 | A | 11/1999 | Fuller et al. | |
| 6,004,709 | A | 12/1999 | Renfer et al. | |
| 6,207,334 | B1 | 3/2001 | Dinh et al. | |
| 8,029,958 | B2 * | 10/2011 | Qi et al. | 430/66 |
| 2007/0072101 | A1 | 3/2007 | Dinh et al. | |
| 2008/0026308 | A1 * | 1/2008 | Qi et al. | 430/58.4 |
| 2008/0085459 | A1 * | 4/2008 | Kami et al. | 430/66 |

* cited by examiner

*Primary Examiner* — Mark F Huff
*Assistant Examiner* — Rachel Zhang
(74) *Attorney, Agent, or Firm* — Pillsbury Winthrop Shaw Pittman LLP

(57) ABSTRACT

Embodiments pertain to a novel imaging member, namely, an imaging member or photoreceptor comprising a binderless overcoat layer which exhibits substantially improved electrical performance, such as low residual potential and good electrical cyclic stability. The overcoat layer of the present embodiments is formed from a formulation comprising a small transport molecule, a crosslinking agent, an acid catalyst and a solvent.

16 Claims, 2 Drawing Sheets

BINDERLESS OVERCOAT LAYER

CROSS-REFERENCE TO RELATED APPLICATIONS

This application is a continuation-in-part of U.S. application Ser. No. 11/275,134 filed Dec. 13, 2005 now U.S. Pat. No. 7,759,032, and which is expressly incorporated herein by reference.

BACKGROUND

The present embodiments pertain to a novel imaging member, namely, an imaging member or photoreceptor comprising a binderless overcoat layer which exhibits substantially improved electrical performance, such as low residual voltage or potential and good electrical cyclic stability.

In electrophotographic or electrostatographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrostatographic copying process is well known and is commonly used for light lens copying of an original document. Analogous processes also exist in other electrostatographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The outer surface of the image bearing member is charged with the rubbing friction at the contact area. The contact type charging device charges the image bearing member to a predetermined potential. Typically the contact type charger is in the form of a roll charger such as that disclosed in U.S. Pat. No. 4,387,980, the relative portions thereof incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer (sometimes referred to as an "interfacial layer"), a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Current long-life overcoat layers have experienced high residual potential and high potential during operation. This poor electrical performance was discovered to be due mainly to the low mobility of charge transport molecules used in the overcoat layers. To avoid the poor electrical performance, and to match the good image quality of those imaging members without overcoat layers, a substantial change in the thickness of the charge generation layer and the charge transport layer must be implemented. However, changes in thickness of the imaging layers lead to other negative effects in the performance of the photoreceptor, such as light shock or increase in cost due to changes in material and production. Thus, there is a need for an overcoat layer that provides similar performance as the current long-life overcoat layers but has much less negative impact on the overall electrical performance of the photoreceptor and requires much less change in thickness of the layers beneath the overcoat layer.

The present embodiments provide for a binderless overcoat layer that imparts long-life service to the photoreceptor and has little negative impact on overall electrical performance of the photoreceptor.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is provided an imaging member, comprising a substrate, a charge generation layer disposed on the substrate, a charge transport layer disposed on the charge generation layer, and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent.

In another embodiment, there is provided an imaging member, comprising a substrate, a charge generation layer disposed on the substrate, a charge transport layer disposed on the charge generation layer, and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent, and further wherein a percentage of the alcohol-soluble charge transport molecule solids in the overcoat solution is less than about 60%.

Yet another embodiment, there is provided an image forming apparatus for forming images on a recording medium comprising (a) an imaging member having a charge retentive-surface for receiving an electrostatic latent image thereon, wherein the imaging member comprises a substrate, a charge generation layer disposed on the substrate, a charge transport layer disposed on the charge generation layer, and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent, (b) a development component for applying a developer material to the charge-retentive surface to develop the electrostatic latent image to form a developed image on the charge-retentive surface, (c) a transfer component for transferring the developed image from the charge-retentive surface to a copy substrate, and (d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
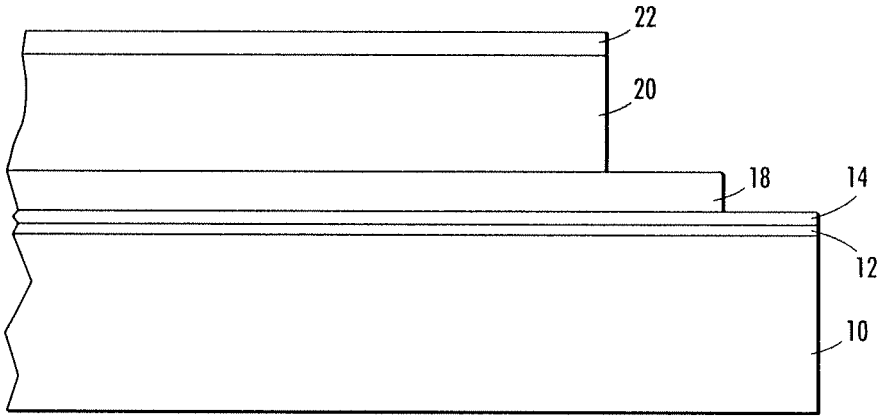
FIG. 1 is a cross-section of an imaging member comprising an inventive overcoat layer according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments generally pertain to a novel imaging member or photoreceptor which comprises a binderless overcoat layer. As compared to the current long-life overcoat layers, the binderless overcoat layer provides a photoreceptor that exhibits substantially improved electrical performance, such as low residual potential and good electrical cyclic stability.

Current overcoat layer formulations have experienced high residual potential and high potential during operation. For example, in one current overcoat layer formulation comprising at least a film-forming resin and a terphenyl hole transporting molecule, preferably a terphenyl diamine hole transporting molecule, a melamine crosslinking agent, and an acid catalyst poor electrical performance is observed in scorotron charging systems due to the low mobility of the charge transport molecule used in the overcoat layer.

In the present embodiments, there is provided a binderless photoreceptor overcoat layer formulation comprising charge transport molecules, a crosslinking agent, an acid catalyst and a solvent. Photoreceptors employing an overcoat layer formed from this formulation have exhibited long service life as the conventional overcoat layers but also exhibit good image quality with substantially less negative impact on electrical performance. In particular embodiments, the novel photoreceptor exhibits similar low wear rate as those using conventional overcoat layers, e.g., from about 4 to about 6 nm/$k_{cycle}$, but also exhibits good image quality, e.g., low A-zone deletion and ghosting, with improved electrical performances, e.g., low $V_r$ and stable electrical cyclic stability.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member having a drum configuration. As can be seen, the exemplary imaging member includes a rigid support substrate 10, an electrically conductive ground plane 12, an undercoat layer 14, a charge generation layer 18, a charge transport layer 20, and an overcoat layer 22. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

Figure 2:
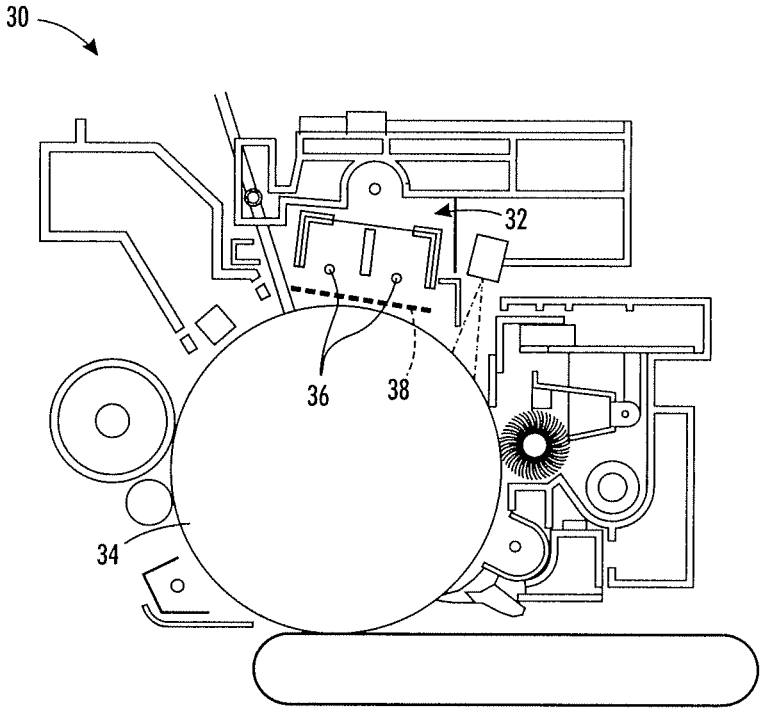
FIG. 2 is a side view showing the structure of an image forming apparatus according to the present embodiments.

FIG. 2 is an exemplary embodiment of an image forming apparatus 30. The image forming apparatus 30 has, at the periphery of a drum-shaped photosensitive body 34, a scorotron charger 32 which relates to the present embodiments and which is replaceable. The image forming apparatus 30 further includes two corotron wires 36 and a grid 38. The grid 38 facilitates diffusion of the charge pattern through the grid pattern to produce uniform charging.

Figure 3:
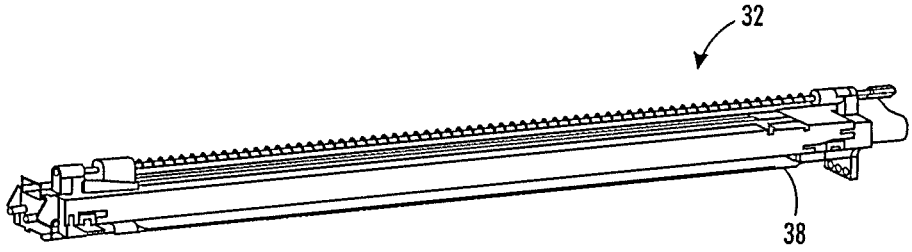
FIG. 3 is a perspective view of a scorotron charger used in the image forming apparatus of the present embodiments.
Figure 4:
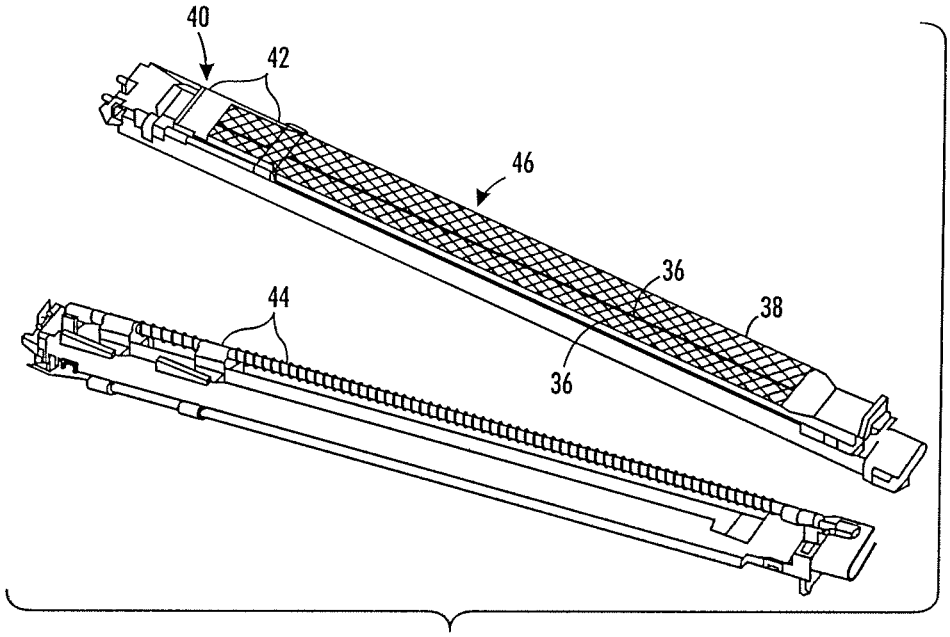
FIG. 4 is a perspective view of the scorotron charger used in the image forming apparatus of the first present embodiments.

As shown in FIGS. 3 and 4, the scorotron charger 32 is a long, narrow device which is provided along the direction of the rotational axis of the photosensitive body 34, and has two corotron wires 36, a grid 38 relating to the present embodiments, and a cleaning mechanism 40. The grid 38 is disposed so as to be positioned between the corotron wires 36 and the photosensitive body 34, and so as to be able to be replaced. The cleaning mechanism 40 cleans the grid 38.

The cleaning mechanism 40 has a brush 42 and a moving mechanism 44. The brush 42 press-contacts the grid 38 from the side at which the corotron wires 36 are disposed. The moving mechanism 44 slides the brush 42 along the photosensitive body 34 in a manner in which the brush 42 press-contacts the grid 38, and cleans the grid 38 due to the brush 42 sliding along the grid 38.

The grid 38 is shaped so as to be long in the longitudinal direction of the scorotron charger 32. An opening pattern 46 is formed in the grid 38 so that the grid 38 may be mesh-like.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones. azo pigments including bis-, tris- and tetrakis-azos: and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl)carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

To improve photoreceptor wear resistance, a protective overcoat layer is provided over the charge transport layer. In the present embodiments, there is an overcoat layer the provides both long service life and exhibits better electrical performance than conventional overcoat layers in xerography systems, such as scorotron charging systems. In embodiments, the overcoat layer solution comprises an alcohol soluble small transport molecule such as, for example, N,N'-diphenyl-N,N'-bis(3-hydroxyphenyl)-[1,1'-biphenyl]-4,4'-diamine (DHTBD), and a crosslinking agent such as, for example, a melamine formaldehyde crosslinking agent. In one embodiment, the crosslinking agent is CYMEL 303, a melamine formaldehyde crosslinking agent available from Cytec Corporation (West Paterson, N.J.). CYMEL 303 is a commercial grade of hexamethoxymethylmelamine supplied in liquid form. To facilitate the crosslinking process, the combination of the small transport molecule and the crosslinking agent takes place in the presence of a strong acid solution such as, for example, toluenesulfonic acid. In embodiments, the acid catalyst used is NACURE 587 available from King Industries (Norwalk, Conn.). In particular embodiments, the alcohol-soluble charge transport molecule is present in an amount of from about 55 percent to about 75 percent of the dried overcoat layer, the melamine formaldehyde crosslinking agent is present in an amount of from about 23 percent to about 43 percent of the dried overcoat layer, and the acid catalyst is present in an amount of from about 0.5 percent to about 2 percent of the dried overcoat layer.

The overcoat layer does not contain binder resin and instead uses a terphenyl hole transporting molecule, such as DHTBD. Unlike the conventional overcoat layer using binders, the overcoat formulation of the present embodiments does not require a heating step during the mixing process of the small transport molecule and crosslinking agent. The terphenyl hole transporting molecules used in the present embodiments, such as for example, DHTBD, have higher solubility than that of the small transport molecules, e.g., N,N'-diphenyl-N,N'-di(3-hydroxyphenyl)-terphenyl-diamine (DHTER), used in the current, conventional overcoat layers. Consequently, because of the higher solubility of the small transport molecule in the present embodiments, there is no requirement for heating the mixing process which saves extra time and cost in the production plant.

A suitable hole transport or small transport molecule is utilized in the overcoat layer, to improve the charge transport mobility of the layer. Preferably, the hole transport material is a terphenyl hole transporting molecule, preferably a terphenyl diamine hole transporting molecule. In embodiments, the small transport molecule has a percent solids ranging from about 50 percent to about 65 percent in the overcoat solution. In embodiments, the hole transporting molecule is alcohol-soluble, to assist in its application along with the polymer binder in solution form. However, alcohol solubility is not required, and the combined hole transporting molecule and polymer binder can be applied by methods other than in solution, as needed. In embodiments, the terphenyl hole transporting molecule is represented by the following formula:

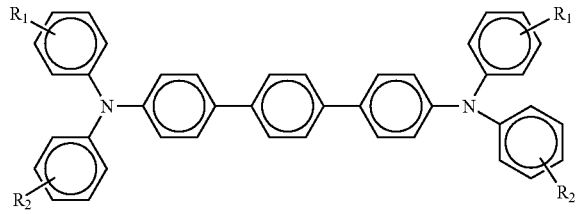

where each $R_1$ and $R_2$ are independently selected from the group consisting of —H, —OH, alkyl (—$C_nH_{2n+1}$) where n is from 1 to about 10 such as from 1 to about 5 or from 1 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from 1 to about 5 or from 1 to about 10. Suitable examples of aryl groups include, for example, phenyl, naphthyl, biphenyl, and the like. In one embodiment, each $R_1$ is —OH, to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each R2 is independently an alkyl, aralkyl or aryl group as defined above. In embodiments, the hole transport material is soluble in the selected solvent used in forming the overcoating layer.

In forming the formulation of the overcoating layer, any suitable crosslinking agents, catalysts, and the like can be included in known amounts for known purposes. In embodiments, the crosslinking agent has a percent solids ranging from about 34 percent to about 49 percent solids in the overcoat solution. Incorporation of a crosslinking agent or accelerator provides reaction sites to interact with the terphenyl hole transporting molecule, to provide a branched, crosslinked structure. When so incorporated, any suitable crosslinking agent or accelerator can be used, including, for example, trioxane, melamine compounds, and mixtures thereof. Where melamine compounds are used, they can be suitable functionalized to be, for example, melamine formaldehyde, methoxymethylated melamine compounds, such as glycouril-formaldehyde and benzoguanamine-formaldehyde, and the like. An example of a suitable methoxymethylated melamine compound is Cymel 303, which is a methoxymethylated melamine compound with the formula $(CH_3OCH_2)_6N_3C_3N_3$ and the following structure:

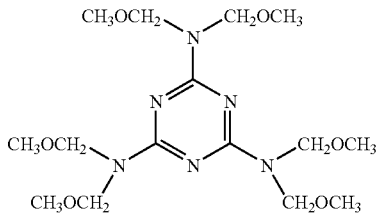

Crosslinking is generally accomplished by heating in the presence of a catalyst. Thus, the overcoat solution can also preferably include a suitable catalyst. Any suitable catalyst may be employed. Typical catalysts include, for example, oxalic acid, maleic acid, carbollylic acid, ascorbic acid, malonic acid, succinic acid, tartaric acid, citric acid, p-toluenesulfonic acid, methanesulfonic acid, and the like and mixtures thereof.

If desired or necessary, a blocking agent can also be included. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as Cycat 4040, available from Cytec Industries.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as the terphenyl compound, catalyst, temperature and time used for the reaction. Preferably, the terphenyl compound is cross linked at a temperature between about 100° C. and about 150° C. A typical cross linking temperature used for the terphenyl compound with p-toluenesulfonic acid as a catalyst is less than about 140° C. for about 40 minutes. A typical concentration of acid catalyst is between about 0.01 and about 5.0 weight percent based on the weight of the terphenyl compound. In embodiments, the acid catalyst has about 1 percent solids in the overcoat solution. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the transport molecule in the crosslinked polymer network.

Any suitable alcohol solvent may be employed for the overcoat solution. Typical alcohol solvents include, for example, butanol, propanol, methanol, 1-methoxy-2-propanol, and the like and mixtures thereof. In embodiments, the solvent is available at about 20 percent solids. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, it is preferred that higher boiling alcohol solvents be avoided, as they can interfere with the desired cross-linking reaction.

All the components utilized in the overcoating solution of this disclosure should preferably be soluble in the solvents or solvents employed for the overcoating. When at least one component in the overcoating mixture is not soluble in the solvent utilized, phase separation can occur, which would adversely affect the transparency of the overcoating and electrical performance of the final imaging member.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range from about 1 or about 2 microns up to about 10 or about 15 microns or more. A thickness of between about 1 micrometer and about 5 micrometers in thickness is preferred, in embodiments. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport holes during imaging and should not have too high a free carrier concentration. Free carrier concentration in the overcoat increases the dark decay. Preferably the dark decay of the overcoated layer should be about the same as that of the unovercoated device.

In the dried overcoating layer, the composition can include from about 40 to about 90 percent by weight film-forming binder, and from about 60 to about 10 percent by weight terphenyl hole transporting molecule. For example, in embodiments, the terphenyl hole transporting molecule can be incorporated into the overcoating layer in an amount of from about 20 to about 50 percent by weight. As desired, the overcoating layer can also include other materials, such as conductive fillers, abrasion resistant fillers, and the like, in any suitable and known amounts.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

The present embodiments thus provide for a binderless overcoat layer that exhibits much better wear rate than that of the current, conventional overcoat layer, and additionally substantially avoids poor electrical performance because the charge transport molecule in the overcoat layer does not suffer from low mobility. As such, there is no change in the thicknesses of the charge generation layer or the charge transport layer required to provide for faster pigment mobility from the charge generation layer. Hence, the present overcoat layer does not show any light sensitivity.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

An overcoated photoconductor was prepared according to the following steps. A three component hole blocking or undercoat layer was prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was coated via a dip coater on a 30 millimeter aluminum tube, and the layer resulting was pre-heated at 59° C. for 13 minutes, humidified at 58° C. (dew point of 54° C.) for 17 minutes, and dried at 135° C. for 8 minutes. The thickness of the undercoat layer obtained was approximately 1.3 microns.

A photogenerating layer of a thickness of about 0.2 micron comprising hydroxygallium phthalocyanine Type V was deposited on the above hole blocking layer or undercoat layer with a thickness of about 1.3 microns. The photogenerating layer coating dispersion was prepared as follows. 3 Grams of hydroxygallium Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon cloth filter, and the solid content of the dispersion was diluted to about 6 weight percent.

Subsequently, an 18 micron thick charge transport layer was coated on top of the photogenerating layer from a solution prepared from N,N'-diphenyl-N,N-bis(3-methylphenyl)-1,1'-biphenyl-4,4'-diamine (5 grams), a film forming polymer binder PCZ 400 [poly(4,4'-dihydroxy-diphenyl-1-1-cyclohexane, $M_w$ of 40,000)] available from Mitsubishi Gas Chemical Company, Ltd. (7.5 grams) in a solvent mixture of 30 grams of tetrahydrofuran (THF), and 10 grams of monochlorobenzene (MCB) via simple mixing. The charge transport layer was dried at about 135° C. for about 40 minutes.

Example 2

Comparative Example

An overcoated photoconductor was prepared by repeating the process of Example I except that an overcoat layer was coated on top of the charge transport layer. A binderless overcoat formulation was comprised 3.06 g JONCRYL 587 (an acrylic polymer available from BASF Corp., Sturtevant, Wis.), 4 g N,N'-diphenyl-N,N'-di(3-hydroxyphenyl)-terphenyl-diamine (DHTER), 4.3 g CYMEL 303 (an amino crosslinking resin available from Cytec Industries, Inc., Woodland Park, N.J.), 0.66 g NACURE XP-357 (an acid catalyst available from Kind Industries Inc., Norwalk, Conn.), 0.6 g SILCLEAN 3700 (a surface additive available from BYK, Wesel, Germany), and 43.6 g DOWANOL PM glycol ether (a solvent available from The Dow Chemical Co., Midland, Mich.). The solid sum was 11.6 grams and the solvent sum was 44.58 grams, such that the percent of solids was 20.7%.

3.5 microns of this overcoat formulation was coated on top of the charge transport layer with a composition of JONCRYL 587/CYMEL® 303/DHTBD/BYK-SILCLEAN® 3700/NACURE® XP357 at a ratio of 27:37:34:1:1.

Example 3

An overcoated photoconductor was prepared by repeating the process of Example I except that an overcoat layer was coated on top of the charge transport layer. A binderless overcoat formulation was comprised 5.7 g N,N'-diphenyl-N,N'-bis(3-hydroxyphenyl)-[1,1'-biphenyl]-4,4'-diamine (DHTBD), 4.3 g CYMEL 303 (an amino crosslinking resin available from Cytec Industries, Inc., Woodland Park, N.J.), 0.6 g NACURE XP-357 (an acid catalyst available from Kind Industries Inc., Norwalk, Conn.), 0.5 g SILCLEAN 3700 (a surface additive available from BYK, Wesel, Germany), and 23.1 g DOWANOL PM glycol ether (a solvent available from The Dow Chemical Co., Midland, Mich.). The solid sum was 10.25 grams and the solvent sum was 23.92 grams, such that the percent of solids was 30.0%.

3.5 microns of the binderless overcoat formulation was coated on top of the charge transport layer with a composition of CYMEL® 303/DHTBD/BYK-SILCLEAN® 3700/NACURE® XP357 at a ratio of 42:56:1:1.

Example 4

An overcoated photoconductor was prepared by repeating the process of Example I except that an overcoat layer was coated on top of the charge transport layer. A binderless overcoat formulation was comprised 8.5 g N,N'-diphenyl-N,N'-bis(3-hydroxyphenyl)-[1,1'-biphenyl]-4,4'-diamine (DHTBD), 4.3 g CYMEL 303 (an amino crosslinking resin available from Cytec Industries, Inc., Woodland Park, N.J.), 0.6 g NACURE XP-357 (an acid catalyst available from Kind Industries Inc., Norwalk, Conn.), 0.5 g SILCLEAN 3700 (a surface additive available from BYK, Wesel, Germany), and 23.1 g DOWANOL PM glycol ether (a solvent available from The Dow Chemical Co., Midland, Mich.). The solid sum was 13 g grams and the solvent sum was 23.92 grams, such that the percent of solids was 35.3%.

3.5 microns of the binderless overcoat formulation was coated on top of the charge transport layer with a composition of CYMEL® 303/DHTBD/BYK-SILCLEAN® 3700/NACURE® XP357 at a ratio of 33:65:1:1.

Example 5

An overcoated photoconductor was prepared by repeating the process of Example I except that an overcoat layer was coated on top of the charge transport layer. A binderless overcoat formulation was 13.7 g N,N'-diphenyl-N,N'-bis(3-hydroxyphenyl)-[1,1'-biphenyl]-4,4'-diamine (DHTBD), 4.3 g CYMEL 303 (an amino crosslinking resin available from Cytec Industries, Inc., Woodland Park, N.J.), 0.6 g NACURE XP-357 (an acid catalyst available from Kind Industries Inc., Norwalk, Conn.), 0.5 g SILCLEAN 3700 (a surface additive available from BYK, Wesel, Germany), and 23.1 g DOWANOL PM glycol ether (a solvent available from The Dow Chemical Co., Midland, Mich.). The solid sum was 18.25 g grams and the solvent sum was 23.92 grams, such that the percent of solids was 43.3%.

3.5 microns of the binderless overcoat formulation was coated on top of the charge transport layer with a composition of CYMEL® 303/DHTBD/BYK-SILCLEAN® 3700/NACURE® XP357 at a ratio of 23:75:1:1.

Results

Wear Testing

The wear test of the photoconductor was performed using a FX469 (Fuji Xerox) wear fixture. The total thickness of the photoconductor was measured with a Permascope prior to the initiation of each wear test. Thereafter, the photoconductor was placed into the wear fixture for 50 kilocycles. The total thickness was measured again, and the difference in thickness was used to calculate wear rate (nanometers/kilocycle) of the photoconductor. The smaller the wear rate, the more wear resistant is the photoconductor and also the higher is the degree of crosslinking.

As shown in Table 1, the degree of crosslinking of the overcoat (Example 3-Example 5) increases with a decrease in DHTBD concentration. In comparison with the comparative overcoat layer, which has a standard wear rate of from about 5 nm/$k_{cycle}$ to about 7 nm/$k_{cycle}$, the DHTBD level needed in the inventive overcoat layer formulation to match the wear rate of the conventional overcoat layer should comprise less than about 70% solids of DHTBD.

TABLE 1

| Device | Wear Rate (nm/kc) |
|---|---|
| EXAMPLE 1: non-overcoated device | 20 nm/kc-25 nm/kc |
| EXAMPLE 2: comparative overcoated device | 5 nm/kc-7 nm/kc |
| EXAMPLE 3 | 5 nm/kc-7 nm/kc |
| EXAMPLE 4 | 6 nm/kc-8 nm/kc |
| EXAMPLE 5 | 10 nm/kc-12 nm/kc |

Electrical Property Testing

The above prepared two photoconductor devices (Example I and Example II) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves.

The scanner was equipped with a scorotron set to a constant voltage charging at various surface potentials. The devices were tested at surface potentials of −700V (volts) with the exposure light intensity incrementally increased with a data acquisition system where the current to the light emitting diode was controlled to obtain different exposure levels. The exposure light source was a 780 nanometer light emitting diode. The xerographic simulation was completed in an environmentally controlled light tight chamber at ambient conditions (45 percent relative humidity and 20° C.).

In Table 2, electrical performance is shown to improve with an increase in the small transport molecule. In contrast to how wear rate decreases with DHTBD level in the overcoat formulation, electrical properties improved with an increase with DHTBD level in the overcoat formulation. For example, in Table 2, it is seen that residual potential decreases as the percentage of DHTBD in the overcoat formulation increases. It is demonstrated that the DHTBD level in the overcoat formulation used to compensate both wear rate and electrical performance is about 70 percent or less. As compared to the 3.5 micron overcoat layer formed from the conventional formulation, the 3.5 micron overcoat layer formed from the formulation of the present embodiments has a residual potential reduced by at least 100 V.

TABLE 2

| Device | Electrical Residual Voltage after erase (V) |
|---|---|
| EXAMPLE 1: non-overcoated device | 40 |
| EXAMPLE 2: comparative device | 202 |
| EXAMPLE 3 | 130 |
| EXAMPLE 4 | 102 |
| EXAMPLE 5 | 81 |

Light Shock Testing

One of the concerns associated with the current, conventional overcoat formulation is the lack of light shock resistance. Unless the non overcoat design (Example 1) with excellent light shock resistance, the comparative overcoat layer (Example 2) can be exposed to white light of 1000 Lux no more than one minute. Unlike the comparative overcoat layer, however, the new binderless overcoat layers (Example 3 to Example 5) show excellent light shock resistance as shown in Table 1. It also shows that the more transport molecule presents in the overcoat, the less is the light shock impact. Each of the device were then exposed to 10,000 Lux light and measured for the change in electrical performance (e.g., surface potential ($V_0$) and residual potential ($V_L$)) before and after exposure.

TABLE 3

| | Right After Light Shock | |
|---|---|---|
| Device | $\Delta V_o$ | $\Delta V_L$ |
| EXAMPLE 1: non-overcoated device | 5 | 30 |
| EXAMPLE 2: comparative overcoated device | 30 | 100 |
| EXAMPLE 3 | 18 | 40 |
| EXAMPLE 4 | 11 | 24 |
| EXAMPLE 5 | 0 | 8 |

In summary, the present embodiments provide an overcoat layer that demonstrates marked improvement in various aspects as compared to a current, conventional overcoat layer used. For example, the overcoat layer of the present embodiments is prepared form a simplified mixing process that does not require a heating step in forming the overcoat solution. In addition, the overcoat layer of the present embodiments not only provides a wear rate performance similar to that of the current, conventional overcoat layer, but also exhibits much better electrical performance than the current, conventional overcoat layer, such as lower residual potential and increased light shock resistance. As such, the overcoat layer of the present embodiments does not require modifications to the thicknesses of the layers underneath the overcoat layer to achieve a desirable $V_L$ that would otherwise be required in a current, conventional overcoat layer.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member, comprising:

a substrate;

a charge generation layer disposed on the substrate;

a charge transport layer disposed on the charge generation layer; and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent, wherein the alcohol-soluble charge transport molecule is a terphenyl arylamine represented by the formula:

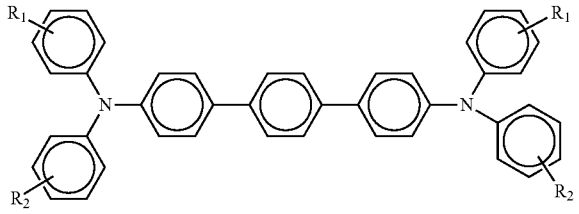

where each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms; wherein the overcoat layer does not contain a binder resin.

2. The imaging member of claim 1, wherein each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms.

3. The imaging member of claim 1, wherein each $R_1$ is —OH and each $R_2$ is selected from the group consisting of —H, alkyl, aralkyl and aryl groups.

4. The imaging member of claim 1, wherein the alcohol-soluble charge transport molecule is present in an amount of from about 55 percent to about 75 percent of the dried overcoat layer.

5. The imaging member of claim 1, wherein the melamine formaldehyde crosslinking agent is present in an amount of from about 23 percent to about 43 percent of the dried overcoat layer.

6. The imaging member of claim 1, wherein the acid catalyst is present in an amount of from about 0.5 percent to about 2 percent of the dried overcoat layer.

7. The imaging member of claim 1, wherein the charge transport molecule has a percent solids ranging from about 50 percent to about 65 percent of the overcoat solution.

8. The imaging member of claim 1, wherein the crosslinking agent has a percent solids ranging from about 34 percent to about 49 percent solids of the overcoat solution.

9. The imaging member of claim 1, wherein the overcoat layer has a thickness of from about 1 micron to about 5 microns.

10. The imaging member of claim 1 further exhibiting a reduction in residual potential of at least 100 V as compared to an imaging member without the binderless overcoat layer.

11. The imaging member of claim 1, wherein the alcohol-soluble charge transport molecule comprises N,N'-diphenyl-N,N'-di(3-hydroxyphenyl)-terphenyl-diamine.

12. An imaging member, comprising:

a substrate;

a charge generation layer disposed on the substrate;

a charge transport layer disposed on the charge generation layer; and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent, and further wherein a percentage of the alcohol-soluble charge transport molecule solids in the overcoat solution is less than about 60%, wherein the alcohol-soluble charge transport molecule is a terphenyl arylamine represented by the formula:

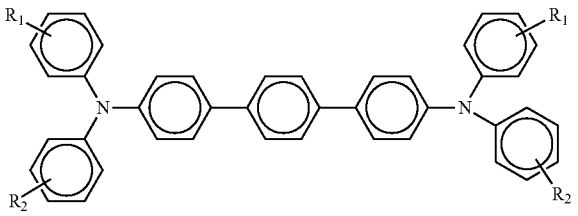

where each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms; wherein the overcoat layer does not contain a binder resin.

13. The imaging member of claim 12, wherein a percentage of the charge transport molecule solids in the overcoat solution is from about 55% to about 60%.

14. An image forming apparatus for forming images on a recording medium comprising:

a) an imaging member having a charge retentive-surface for receiving an electrostatic latent image thereon, wherein the imaging member comprises a substrate;

a charge generation layer disposed on the substrate;

a charge transport layer disposed on the charge generation layer; and a binderless overcoat layer disposed on the charge transport layer, wherein the overcoat layer is formed from an overcoat solution comprising an alcohol-soluble charge transport molecule, a melamine formaldehyde crosslinking agent, and an acid catalyst in a solvent, wherein the alcohol-soluble charge transport molecule is a terphenyl arylamine represented by the formula:

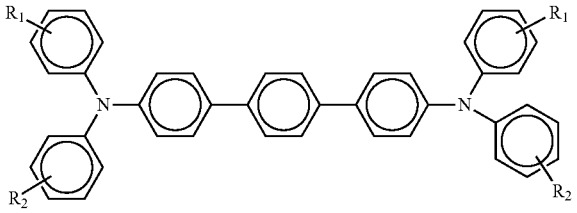

where each $R_1$ and $R_2$ are independently selected from the group consisting of —H, —OH, —$C_nH_{2n+1}$ where n is from 1 to about 10, aralkyl, and aryl groups, the aralkyl and aryl groups having from about 5 to about 30 carbon atoms; wherein the overcoat layer does not contain a binder resin;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

15. The image-forming apparatus of claim 14 further including a scorotron charger for charging the charge retentive-surface to a substantially uniform potential.

16. The image-forming apparatus of claim 14, wherein the imaging member exhibits a reduction in residual potential of at least 100 V as compared to an imaging member without the binderless overcoat layer.

* * * * *